United States Patent [19]

Boeshart

[11] Patent Number: 4,936,540

[45] Date of Patent: Jun. 26, 1990

[54] TIE FOR CONCRETE FORMS

[76] Inventor: Patrick E. Boeshart, Rte. 1, Box 134, Sioux City, Iowa 51108

[21] Appl. No.: 356,519

[22] Filed: May 25, 1989

Related U.S. Application Data

[63] Continuation-in-part of Ser. No. 309,111, Feb. 13, 1989.

[51] Int. Cl.[5] ..... E04G 17/06

[52] U.S. Cl. ..... 249/216; 52/426; 52/562; 52/699; 249/40; 249/218; 249/219.2

[58] Field of Search ..... 249/33, 38, 40, 44, 249/45, 46, 213, 216, 217, 218, 219.1, 219.2; 52/426, 427, 562, 563, 566, 567, 570, 571, 698, 699

[56] References Cited

U.S. PATENT DOCUMENTS

| | | | |
|---|---|---|---|
| 1,488,726 | 4/1924 | Alexander et al. | 249/218 |
| 1,994,166 | 3/1935 | Beghetti | 249/218 |
| 2,099,260 | 11/1937 | Colt | 249/43 |
| 2,794,234 | 6/1957 | White | 249/218 |
| 3,069,743 | 12/1962 | Luyben | 249/218 |
| 3,625,470 | 12/1971 | Shoemaker | 249/43 |
| 4,300,747 | 11/1981 | Brow | 249/218 |
| 4,706,429 | 11/1987 | Young | 52/309.12 |

FOREIGN PATENT DOCUMENTS

| | | | |
|---|---|---|---|
| 193120 | 11/1957 | Austria | 249/218 |

*Primary Examiner*—James C. Housel

*Attorney, Agent, or Firm*—Zarley, McKee, Thomte, Voorhees & Sease

[57] ABSTRACT

A tie for concrete forms includes an elongated strap with opposing first and second ends. The strap has an upwardly projecting intermediate portion which prevents the movement of form panels inwardly on one end of the strap. A notch in the first end of the strap receives a waler to hold form panel from moving outwardly along the strap. A fixed plate on the second end of the strap holds a form panel from moving outwardly along the strap. Beveled ends allow the strap to be forced through a polystyrene panel without the need for forming an aperture in the panel prior to insertion of the tie. A tubular spacer may be utilized on intermittent ties to prevent inward movement of the form panels. The spacer has a notch cut therein to allow concrete to flow within the spacer and around the tie.

3 Claims, 7 Drawing Sheets

TIE FOR CONCRETE FORMS

CROSS REFERENCE TO RELATED APPLICATIONS

This is a continuation-in-part of Ser. No. 07/309,111 filed on Feb. 13, 1989 and entitled "TIE FOR CONCRETE FORMS".

TECHNICAL FIELD

The present invention relates generally to ties for poured concrete wall systems, and more particularly to an improved tie which will hold various walers on the outside of the form panels and which will secure a form panel to a completed wall.

BACKGROUND OF THE INVENTION

While wall forming systems have been in use for many years, a recent development in this industry is in the use of expanded polystyrene panels as forms for the poured concrete walls. After the concrete has hardened, the panels may be left in place on the walls to serve as permanent insulation or may be stripped off to reveal the exposed concrete.

Upon introduction of this new wall forming system, it was found that it was unnecessary to use small "building blocks" to create the form panels. Rather, larger and larger panels are now being utilized to create the concrete forms. As the panels grew in size, the applicant herein devised a new type of tie, described in U.S. Pat. No. 4,765,109, which had special ends that could be "knocked off" to easily remove the large panels from the walls. While the patented tie has proved successful for its intended purpose, there are various instances where a different kind of tie would be more convenient and useful.

One problem with the previous tie design was in situations where a large four-foot by eight-foot panel is desired to be used as the forming structure. Because the previous ties were designed to fit in slots in the upper or lower edges, it was not possible to insert a tie intermediate the edges in the panel.

Another problem with prior art forming systems was in the use of ties which would retain the insulation panel permanently on the wall. Such systems are not capable of use on those occasions where an exposed concrete surface is desired. In such instances, it was necessary to revert to the older methods of wooden forms which could be removed from the wall, but which left markings on the concrete wall which remained. While the applicant's previous tie design of U.S. Pat. No. 4,765,109 solved many of these problems in the use of its "knock off ends", those ties could not be utilized in any location other than the edges of the panels. Thus, it would be desirable to create a tie having removable and reusable end pieces, for use in intermediate locations on the form panel. Furthermore, it would be desirable to create a tie having one fixed end for securing a form panel insulation, and with the opposing end thereof having a removable end piece for use in intermediate locations on the form panel.

A further problem in the prior art is in the use of walers to support the form panel system. Typically such walers were bulky systems which had to be supported on their own against the wall, and which required a large number of ties and other materials to install and remove. Not only is the time loss considerable, but it is necessary to utilize a large number of materials and tools which must be carried by the construction crew from site to site.

It is therefore a general object of the present invention to provide an improved tie for use with polystyrene panel-type forms on poured concrete walls.

Another object of the present invention is to provide a tie which can be inserted through the intermediate portion of a polystyrene panel form to retain the form panel in position.

A further object is to provide a concrete wall form tie which has a removable end piece for retaining the panel in position.

Still another object of the present invention is to provide a concrete form panel tie which has a reusable end piece for retaining the panels in position.

Yet another object is to provide a form panel tie which will receive a waler system to maintain alignment of the forming panels.

Another object of the present invention is to provide a concrete form panel tie which has one fixed end piece and one reusable end piece for retaining the panels in position.

These and other objects of the present invention will be apparent to those skilled in the art.

SUMMARY OF THE INVENTION

The tie for concrete forms of the present invention includes an elongated strap with opposing first and second ends. The first end of the strap is beveled to allow the strap to be forced through a polystyrene panel without the need for forming an aperture. A fixed end plate at the second end of the strap retains one form panel on the tie. The first end of the strap may then be forced through a second panel, to form a pair of spaced-apart, parallel panels. The strap has an upwardly projecting intermediate portion which prevents movement of the second form panel inwardly on the strap. A notch in the second end of the strap receives a waler to hold the second form panel from moving outwardly along the strap. Two forms of notches are presently being utilized, one version designed to receive a cylindrical reinforcing rod as a waler, and the other notch designed to receive a length of dimensional lumber as the waler.

In order to maintain uniform separation of the form panels, a tubular spacer is inserted on intermittent ties prior to the installation of the second form panel on the tie. A notch in the spacer allows concrete to flow around the strap and secure the tie in the wall.

DESCRIPTION OF THE PREFERRED EMBODIMENT

Figures 1, 2:
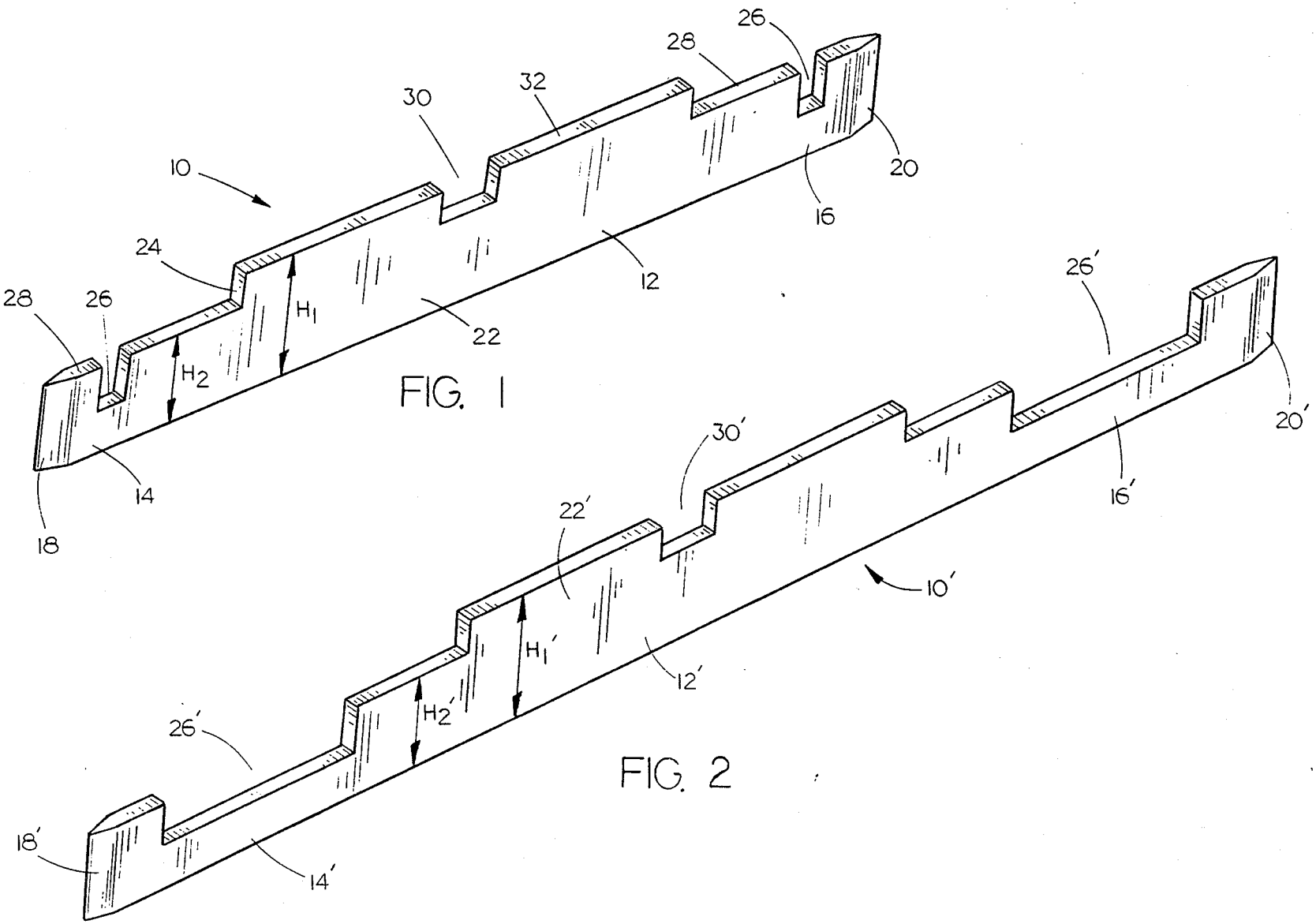
FIG. 1 is a perspective view of a tie.
FIG. 2 is a perspective view of a second embodiment of the tie of FIG. 1.

Referring now to the drawings, in which similar or corresponding parts are designated with the same reference numeral throughout the drawings, and more particularly to FIG. 1, a tie of co-pending patent application Ser. No. 309,111, entitled "TIE FOR CONCRETE FORMS", is designated generally at 10, and is formed from an elongated strap 12 of a synthetic plastic material. Preferably tie 10 is of a thin material so as to have a height substantially greater than its thickness, for a purpose to be described in more detail hereinbelow.

Figure 3:
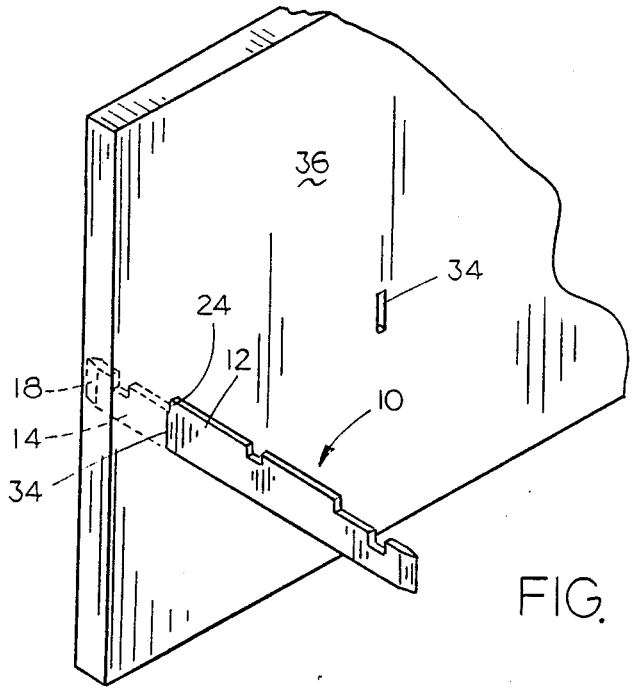
FIG. 3 is a perspective view of the tie of FIG. 1 being inserted through one form panel.
Figure 4:
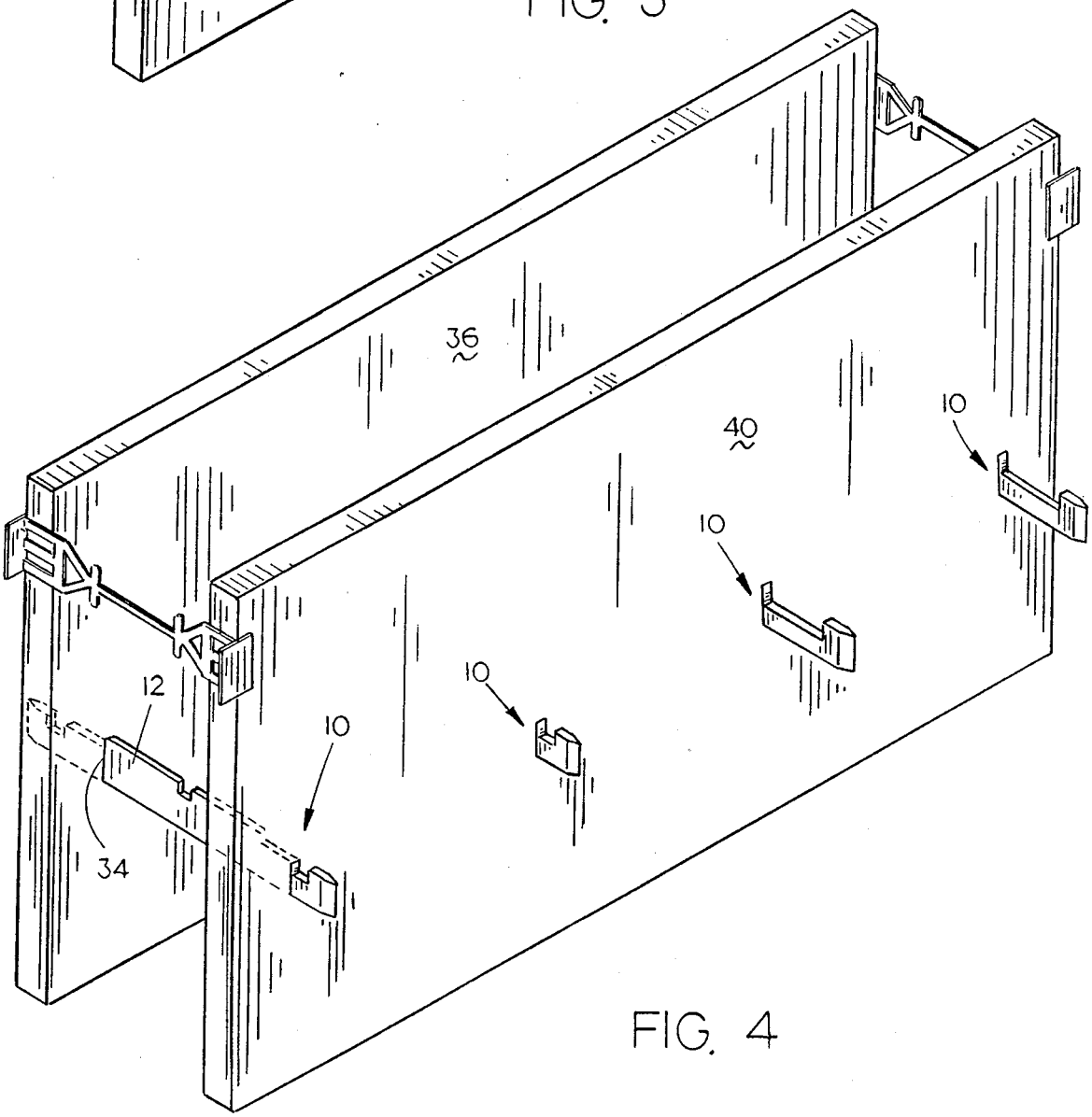
FIG. 4 is a perspective view of a pair of concrete form panels with both embodiments of the ties of FIGS. 1 and 2 installed therethrough ready to receive two different waler systems.

Strap 12 of tie 10 has first and second ends 14 and 16 with a beveled edge 18 and 20, respectively, which may be utilized to force the tie end through a polystyrene form panel, as shown in FIG. 3. An intermediate portion 22 of strap 12 has a height $H_1$ greater than the height of end portions 14 and 16 (identified as $H_2$), so as to form a step 24 between center portion 22 and ends 14 and 16. When an end of strap 12 is inserted through panel 36, as shown in FIG. 3, step 24 will serve as a stop to hold the panel at the appropriate position on tie 10.

Figure 5:
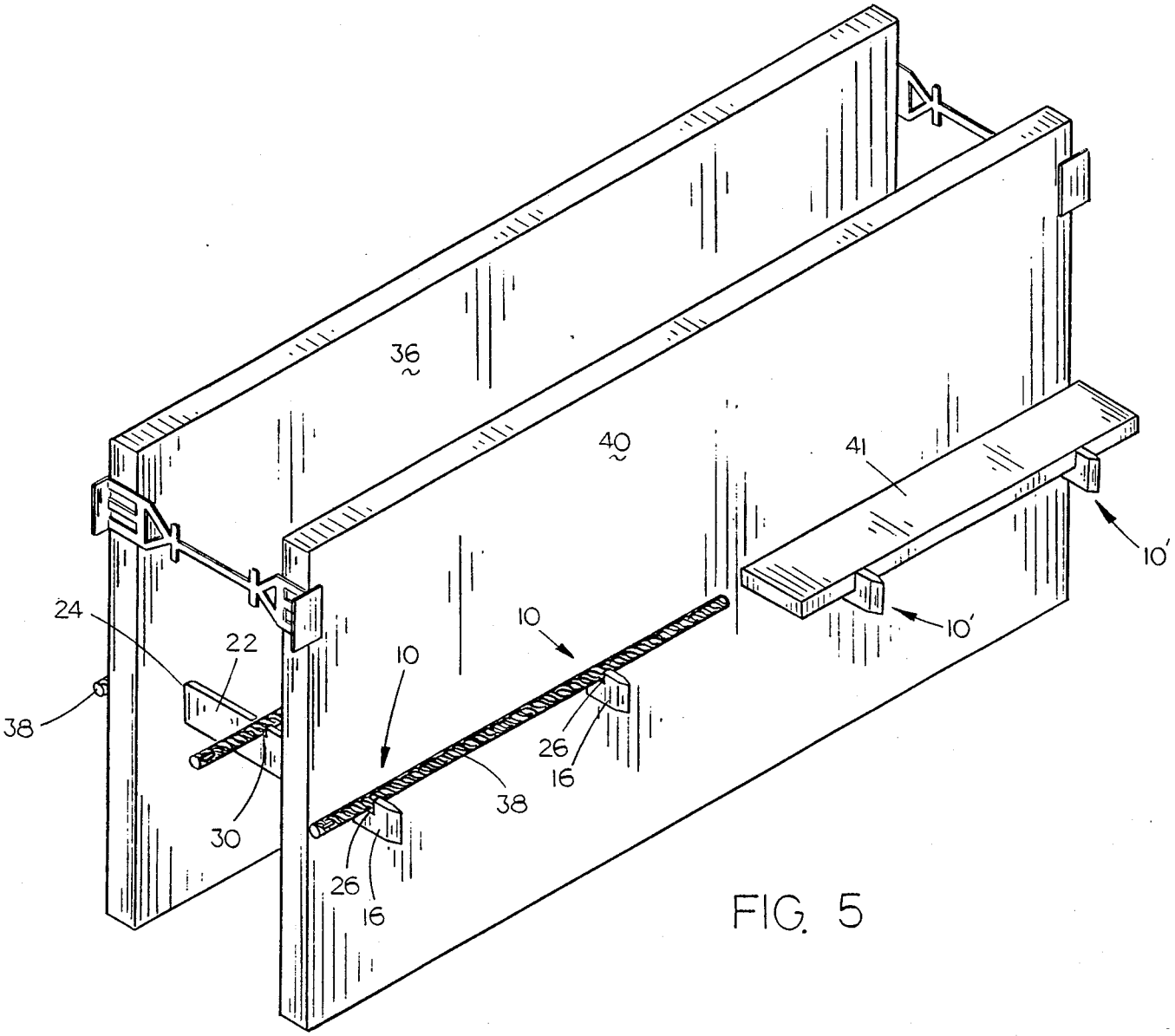
FIG. 5 is a perspective view the same as FIG. 4, having two different walers installed on the ties.

A notch 26 is formed in the upper edge 28 of each end portion 14 and 16 and will receive a cylindrical rod as a waler therein (see FIG. 5). The distance between notch 26 and step 24 is equal to the thickness of the panel through which the tie will be extended, such that a waler will hold the panel securely in position.

A notch 30 in the upper edge 32 of center portion 22 of tie 10 is of a width and depth sufficient to retain a reinforcing rod therein (see FIG. 5).

Referring now to FIGS. 1 and 3–5, tie 10 is utilized by inserting one end 14 through an aperture 34 in a form panel 36, until step 24 abuts against the form panel 36. Beveled surface 18 is provided on end 14 in instances where an aperture 34 is not present in the panel. In such a case, tie 10 is inserted through panel 36 by forcing the beveled edge through the panel. After a series of ties 10 are inserted in panel 36, a reinforcing rod may be inserted in notches 26 protruding on the exterior side of the panel so as to act as a waler rod 38 to lock the panel in position on the ties. A second panel 40 is then attached to the other ends 16 of ties 10, and a second waler rod 38 is dropped in notches 26 thereof to retain panel 40 in place.

The thickness of the wall to be poured is determined by the width of intermediate portion 22 of strap 12, as measured between steps 24. For walls of a greater thickness, a tie having a greater length between steps 24 would be necessary. Once the concrete wall has been poured, waler rod 38 is removed from notches 26 and may be utilized in other construction. Panels 36 and 40 may then slide outwardly off the ends of the ties and can be reused in other construction as well.

Ties 10 are composed of a synthetic plastic material and have a thin cross-section, such that the protruding ends of the ties 14 and 16, which protrude from the concrete wall after removal of form panels 36 and 40, may be easily broken off and removed. This is easily accomplished using a scraper tool or the like and applying a quick sharp blow to the protruding end of the tie. All that will remain will be the concrete wall and a flush cross-section of the tie where it was broken.

Referring now to FIG. 2, a second embodiment of a tie is designated generally at 10′ and includes an elongated strap 12′ of synthetic plastic material. Tie 10′ includes first and second ends 14′ and 16′ each having a beveled end 18′ and 20′. Intermediate portion 22′ has a height $H_1$, greater than that of the ends $H_2$, so as to form steps 24′ in a fashion similar to tie 10. In this embodiment of the invention, a notch 26′ is formed in each end 14′ and 16′ which has a width sufficient to retain a 2×4 (41) or other piece of dimensional lumber therein. Thus, the width of notch 26′ would be approximately three and one-half inches. The distance between notch 26′ and step 24′ would be equal to the thickness of the panel used for the concrete form. A central notch 30′ is again utilized to retain a reinforcement rod or the like.

As shown in FIG. 5, a simple 2×4 (41) can be utilized for a twofold purpose: (1) to retain panels 36 and 40 in position as concrete forms; and (2) to serve as a waler between a series of panels to retain the alignment of the forms.

Figure 7:
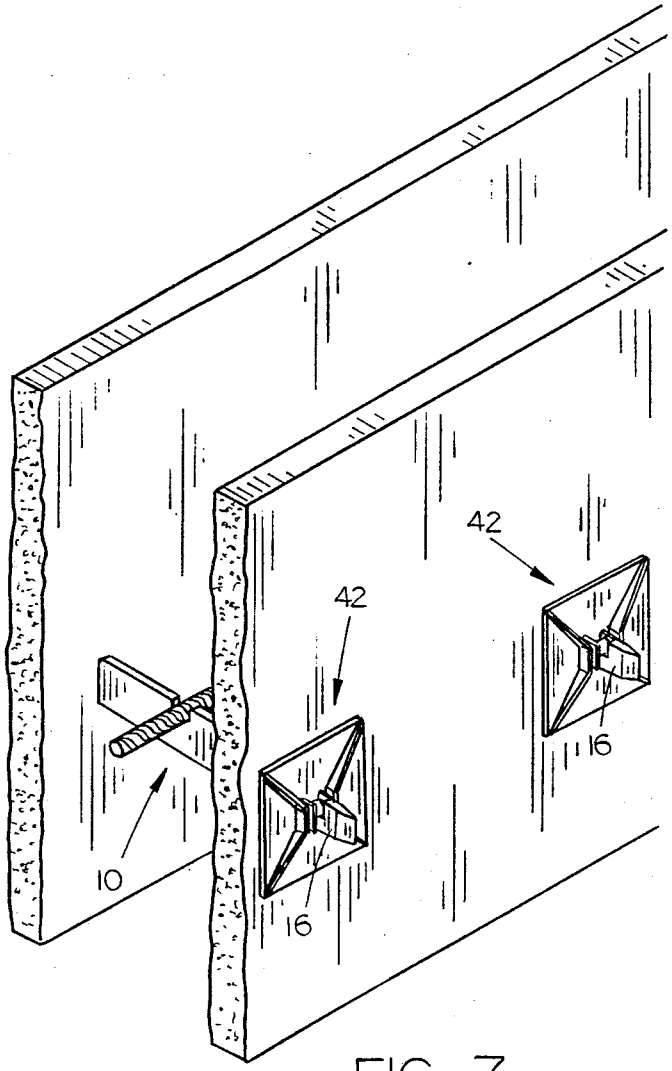
FIG. 7 is a perspective view of a pair of concrete form panels with ties and end pieces installed thereon.
Figure 6:
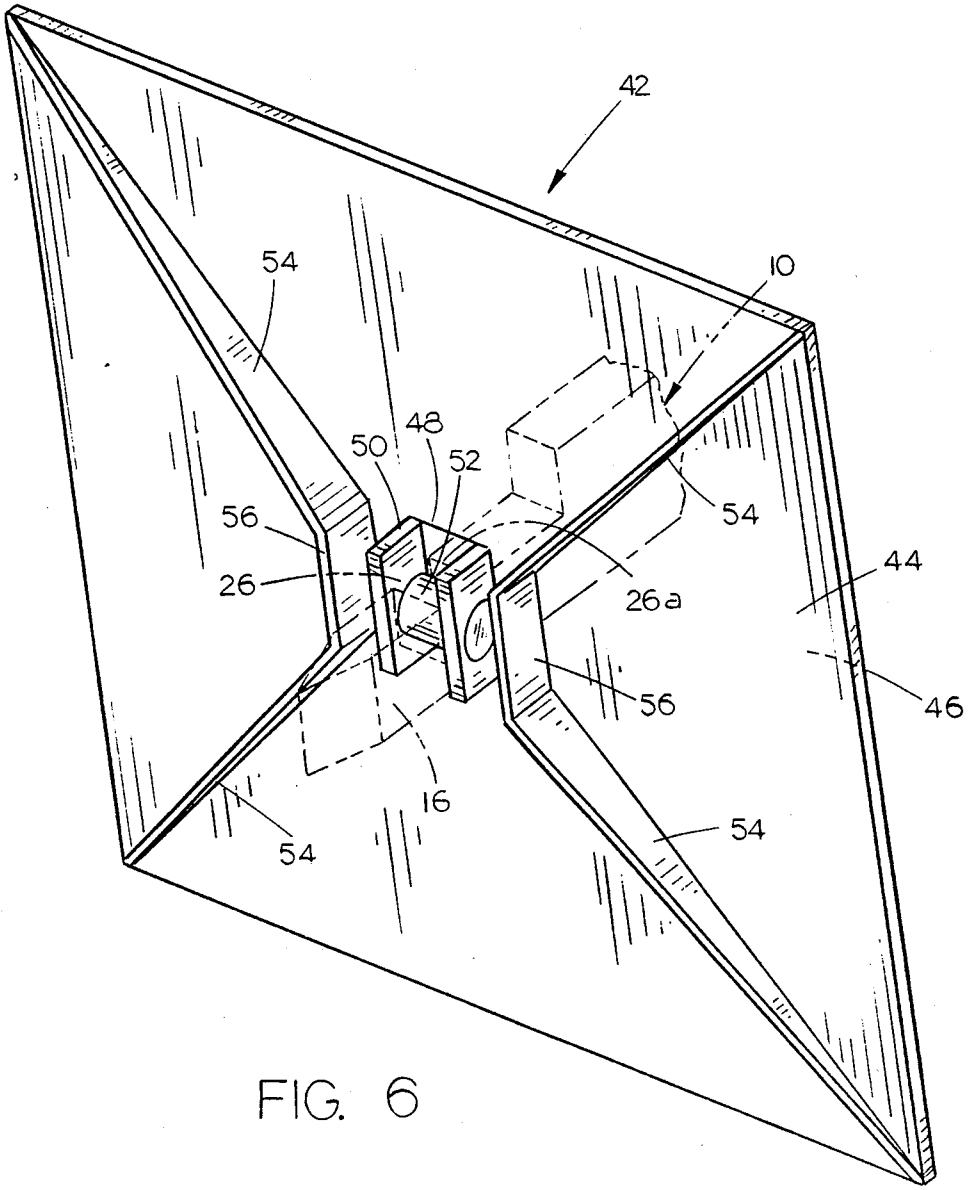
FIG. 6 is an enlarged perspective view of a removable end piece.

In situations where large panels are utilized as concrete forms, and where a greater spacing between the ties is desired, a special removable and reusable end bracket 42 (see FIGS. 6 and 7) is utilized in conjunction with tie 10. End bracket 42 includes a generally square plate 44 having a flat rearward surface 46 (not shown) which will abut and bias against the concrete form panel. Preferably, plate 44 is about four to six inches wide and four to six inches long to create a great surface area for holding the forming panel. A slot 48 is cut in the center of plate 44 and has a width equal to the width of tie 10, and a height greater than the height of end portion 16 of tie 10, such that end portion 16 may be inserted through the slot as discussed hereinbelow. A pair of walls 50 project outwardly from plate 44 adjacent the length of slot 48, and have a pin 52 mounted therebetween. Pin 52 is generally of a diameter which will snugly fit within notch 26 of tie 10 (shown in broken lines). Pin 52 is located between walls 48 near the rearward side 46 such that when bracket 42 is installed on tie 10, rearward surface 46 will be generally flush with the inward edge 26*a* of notch 26.

In order to strengthen plate 44 against large loads on the panel, a series of ribs 54 extend diagonally from each corner substantially to the center of plate 44 and walls 50. A pair of intermediate walls 56 connect the ends of each pair of ribs 54 on each side of aperture 48.

Each bracket can be placed on the end of tie 10 with pin 52 sliding into notch 26 to thereby retain a polystyrene panel in position. The size of the plate 44 assists in retaining the form when a large distance is necessary or desirable between the ties 10.

While ties 10 and 10′ have provided significant advantages over that of the prior art, they are not intended for use where the form panel remains in place upon completion of the wall to provide insulation. Thus, the tie of the present invention modifies the previous design to permit construction of a wall wherein the form panel is permanently secured to the finished concrete wall.

Figure 8:
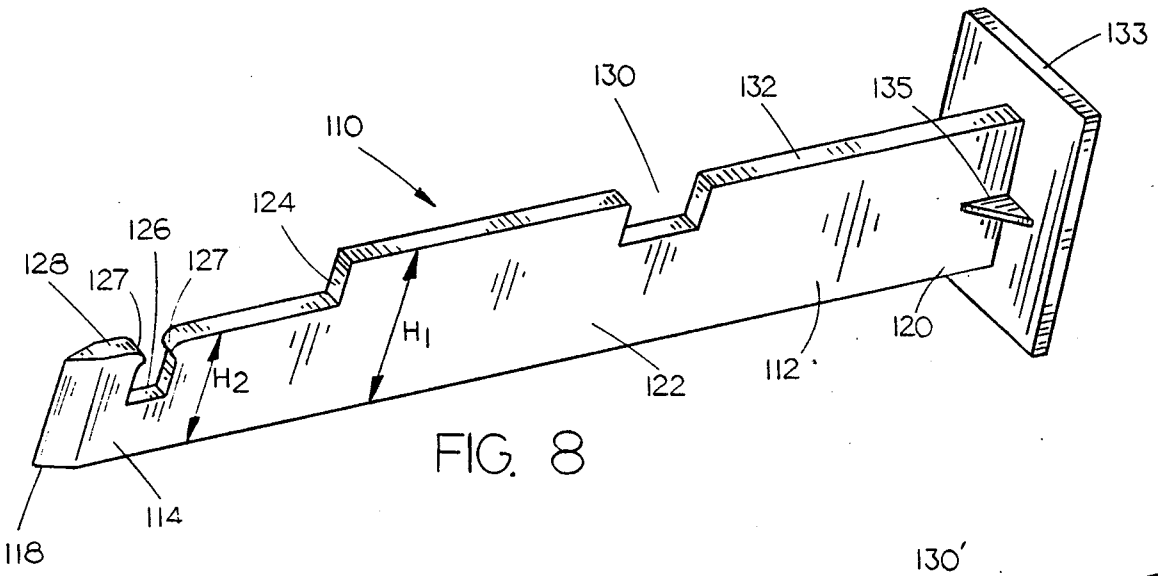
FIG. 8 is a perspective view of a tie of the present invention.

Referring now to FIG. 8, the tie of the present invention is designated generally at 110, and is formed from an elongated strap 112 of a synthetic plastic material. Preferably tie 110 is of a thin material so as to have a height substantially greater than its thickness, for a purpose to be described in more detail hereinbelow.

Strap 112 of tie 110 has first and second ends 114 and 116 with the first end 114 having a beveled edge 118, which may be utilized to force end 114 through a polystyrene form panel, as discussed hereinabove. An integrally formed end plate 133 is fixed perpendicularly on end 116. A gusset plate 135 is formed between end plate 133 and strap 112 to reinforce end plate 133.

An intermediate portion 122 of strap 112 has a height $H_1$ greater than the height of end portion 114 (identified as $H_2$), so as to form a step 124 between center portion 122 and end 114. When end 114 of strap 112 is inserted through a panel 136, as show in FIG. 10, step 124 will serve as a stop to hold panel 136 at the appropriate position on tie 110.

A notch 126 is formed in the upper edge 128 of end portion 114 and will receive a cylindrical rod as a waler therein. Notch 126 includes a pair of inwardly projecting opposing shoulders 127 positioned adjacent to the upper end of the notch. Shoulders 127 will allow a cylindrical waler to be snapped into place, to prevent inadvertant dislocation. The distance between notch 126 and step 124 is equal to the thickness of the form panel 136 through which the tie will be extending, such that a waler will hold the panel 140 securely in position.

Figure 10:
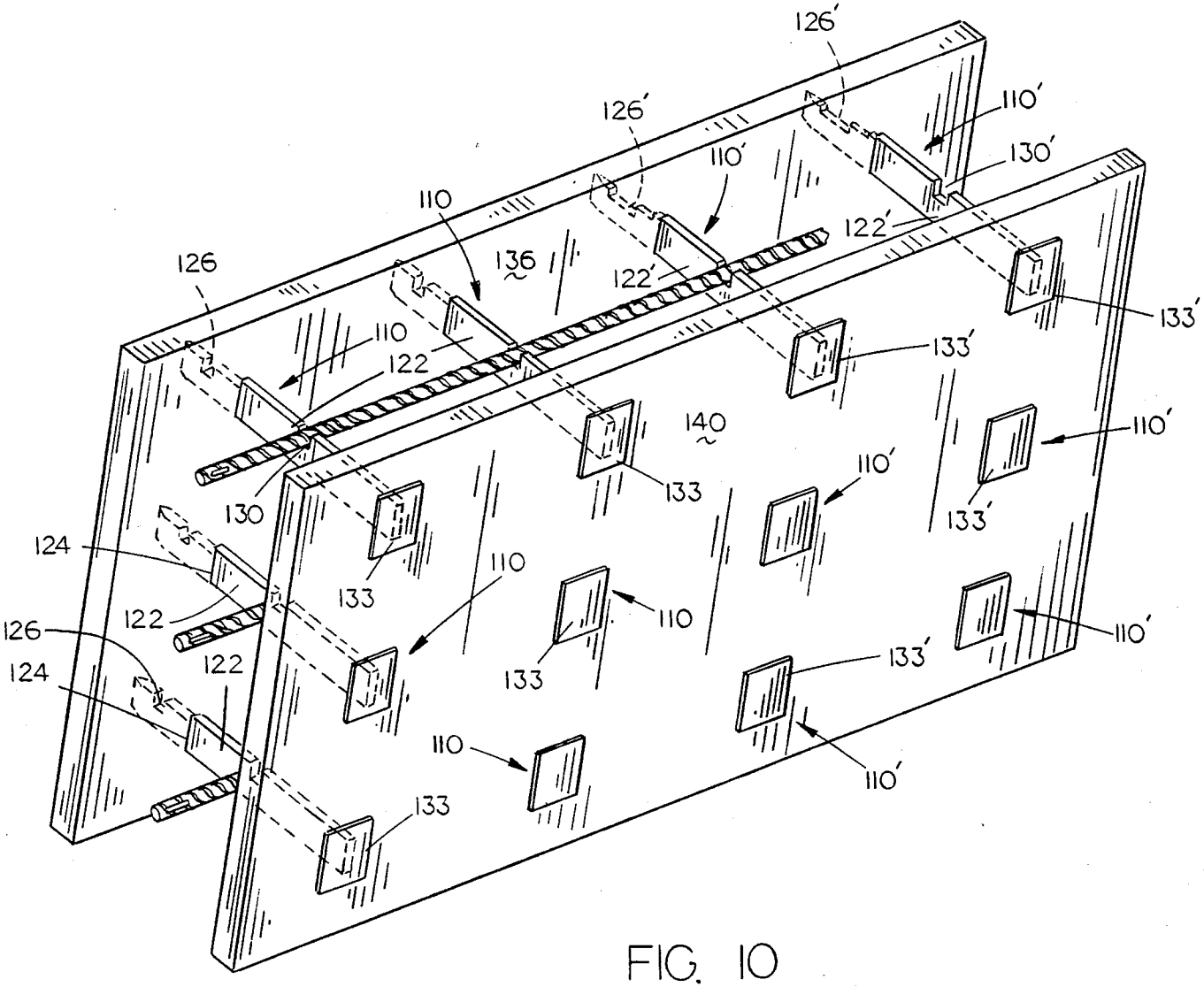
FIG. 10 is a perspective view of a pair of concrete form panels with both embodiments of the ties installed therethrough ready to receive two different waler systems.

A notch 130 in the upper edge 132 of center portion 122 of tie 110 is of a width and depth sufficient to retain a reinforcing rod therein (see FIG. 10).

Figure 11:
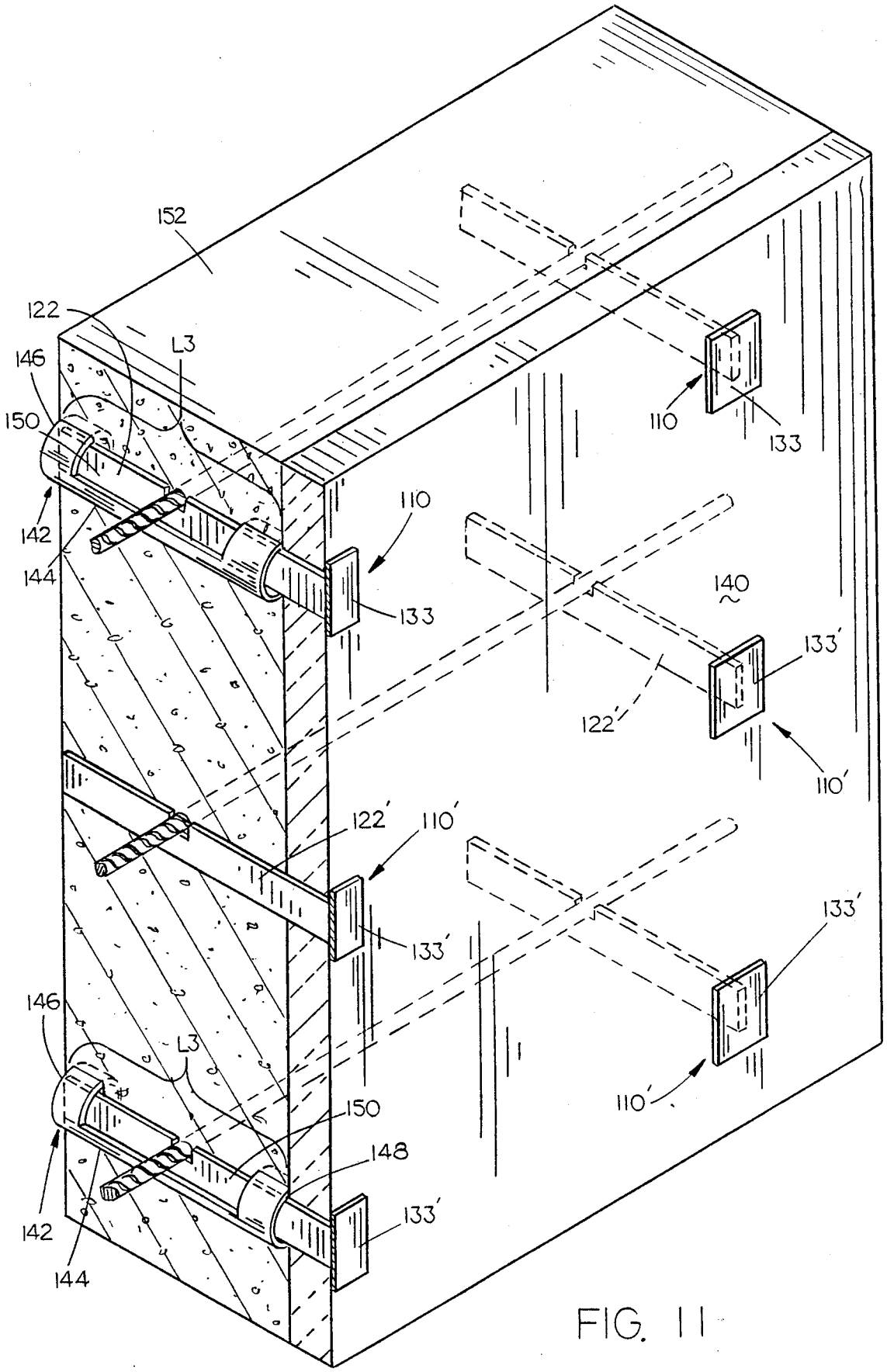
FIG. 11 is a perspective cross-sectional view of a finished concrete wall showing the use of spacers with the ties of the present invention.

Referring now to FIG. 10, ties 110 are first forced through a polystyrene form panel 140, such that panel 140 is placed in contact with end plates 133. In most cases, the friction of the ties against the polystyrene of panel 140 is adequate to prevent panel 140 from moving inwardly on ties 110. However, in some instances, it is preferable to add spacers 142 intermittently between panels 136 and 140 to maintain the spaced-apart relation (see FIG. 11). Spacers 142 are slipped onto the desired ties 110 prior to attachment of the second panel 136, as seen in FIG. 11. After a series of ties 110 are inserted in panel 140, a second opposing panel 136 is attached to end 114 of ties 110 such that the notch 126 protrudes therethrough. A reinforcing rod may be inserted in notches 126 protruding from form panel 136 so as to aCt as a waler to lock panel 136 in position on the ties (in a fashion similar to that shown in FIG. 5).

The thickness of the wall to be poured is determined by the width of intermediate portion 122 of strap 112, as measured between step 124 and end plate 133, less the thickness of form panel 140. For walls of a greater thickness, a tie having a greater length between step 124 and end plate 133 would be necessary. Once the concrete wall has been poured, waler rod 138 (not shown) is removed from notches 126 and may be utilized in other construction, as discussed hereinabove. Panel 136 may then slide outwardly off ends 114 of ties 110 and can be reused in other construction as well. Panel 140 remains firmly secured to the concrete wall 152, and serves as permanent insulation.

Ties 110 are composed of a synthetic plastic material and have a thin cross-section, such that the ends 114 of ties 110, which protrude from the concrete wall after removal of form panels 136, may be easily broken off and removed. This is easily accomplished using a scraper tool or the like and applying a quick sharp blow to the protruding end 114 of the tie 110.

Figure 9:
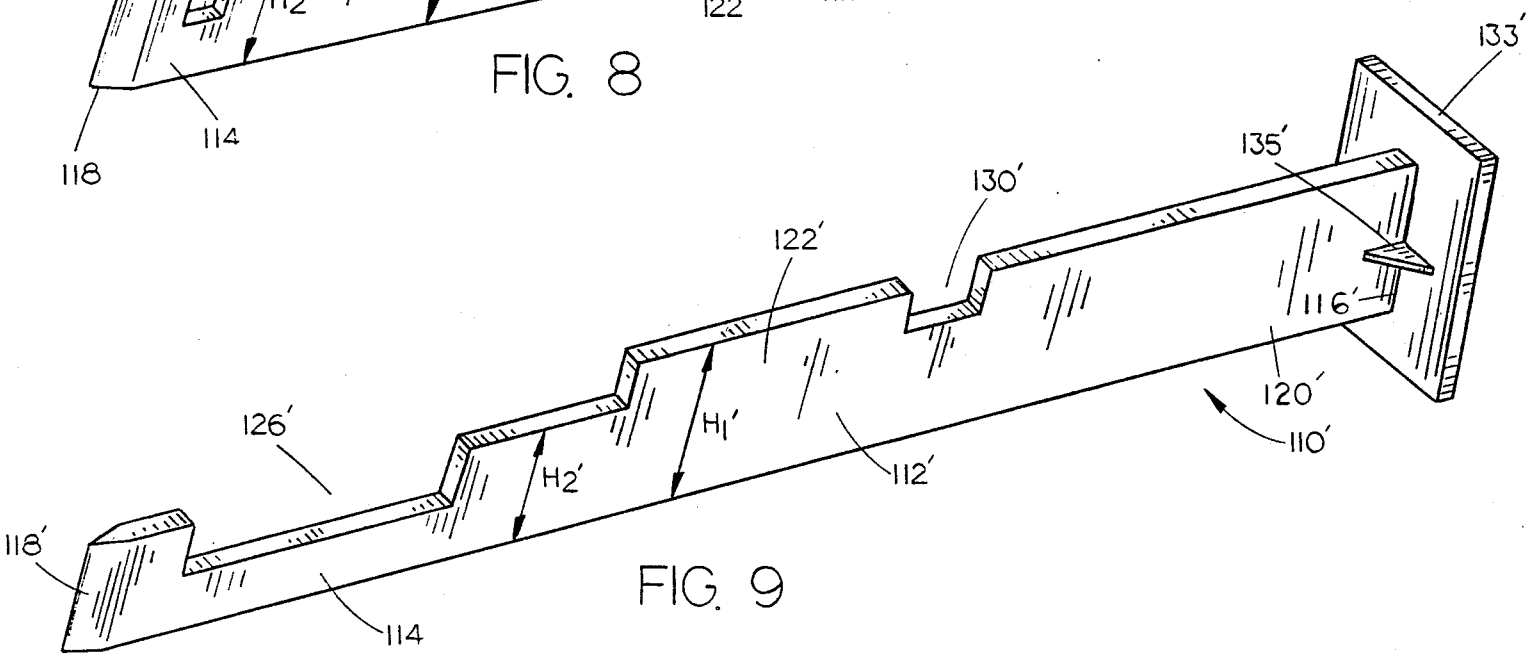
FIG. 9 is a perspective view of a second embodiment of the tie of the present invention.

Referring now to FIG. 9, a second embodiment of the present invention is designated generally at 110' and includes an elongated strap 112' formed from a synthetic plastic material. Tie 110' includes first and second ends 114' and 116' with the first end 114' having a beveled end 118'. Intermediate portion 122' has a height $H_1$, greater than the height $H_2$ end 114', so as to form a step 124', in a fashion similar to tie 110. In this embodiment of the invention, a notch 126' is formed in end 114' which has a width sufficient to retain a 2×4 (41) or other piece of dimensional lumber therein. Thus, the width of notch 126' would be approximately three and one-half inches. The distance between notch 126' and step 124' would be equal to the thickness of the panel used for the concrete form. A central notch 130' is again utilized to retain a reinforcement rod or the like.

It can therefore be seen that a simple 2×4 (41) can be utilized for a twofold purpose: (1) to retain panels 136 in position as concrete forms; and (2) to serve as a waler between a series of panels to retain the alignment of the forms.

In certain circumstances it may be necessary to include a spacer 142 between panels 136 and 140 to prevent panel 140 from moving inwardly on the tie. Step 124 prevents this from occurring with respect to panel 136. Typically, spacers 142 are only necessary near the top of a pair of form panels, since concrete being poured into the forms will force the lower ends of the panels apart.

Referring now to FIG. 11, spacer 142 is a tubular member 144 having a first end 146 and a second end 148. A notch 150 is provided along a portion of one side to allow concrete to flow into the tubular member and firmly secure ties 110 and 110' within wall 152. Ends 146 and 148 of spacer 142 are abutted against the inner surfaces of form panels 140 and 136 respectively, to keep the panels at the appropriate spaced-apart distance. The length of spacer 142 is equal to the thickness of the wall to be poured.

As illustrated in FIG. 11, form panel 140 is permanently secured by ties 110 and 110' to the finished concrete wall 152. Additionally, each end plate 133 and 133' can be utilized as a base for receiving screws and other fasteners for connecting finished surfaces to the insulated wall.

Whereas the invention has been shown and described in connection with the above embodiments thereof, it will be understood that many modifications, substitutions and additions may be made. For example, the cross-sectional shape of the tie 110 and 110' is not critical to the invention, as long as the cross-sectional dimension allows for the tie to be easily broken by a sharp blow once the concrete wall has been formed. Also, the size and location of notch 150 in spacer 142 is not critical, since any opening which allows concrete to flow within the spacer will serve to hold the ties in place.

Thus, it can be seen that the concrete form tie of the present invention fulfills at least all of the above-stated objectives.

I claim:

1. A tie for interlocking a pair of spaced-apart form panels, comprising:

a generally flat, elongated strap having first and second opposite end portions, upper and lower edges, opposite sides and an intermediate portion between said end portions;

said strap including means for retaining the panels in spaced-apart relation on opposite ends of said intermediate portion, comprising;

stop means located at the first end of said intermediate portion for preventing movement of a panel inwardly on the first end portion of said tie towards the intermediate portion;

an end plate affixed perpendicularly on said second end portion for preventing movement of a panel outwardly off of said second end portion; and waler receiving means on the first end portion of said tie, spaced outwardly from said stop means, for receiving a waler to prevent outward movement of the panel off said first end portion;

said stop means comprising said intermediate portion being formed with a height greater than the height of said first end portion, to create a step at the end of said intermediate portion adjacent said first end portion, such that a panel will abut the step and be prevented from moving inwardly on the tie;

said waler receiving means comprising said first end portion being formed with a notch extending downwardly from the upper edge thereof, said notch having an inner edge, outer edge, and bottom edge, the width of said notch between the inner and outer edges being adapted to receive the width of a predetermined waler therein, whereby a waler inserted in said notch will prevent outward movement of a panel;

said inner edge of said notch being spaced a distance from said stop means equal to the thickness of a panel, such that insertion of a waler in said notch will retain a panel between said waler and said stop means.

2. The tie of claim 1 wherein said notch further comprises a first shoulder on the inner edge of said notch adjacent said strap upper edge; and a second shoulder portion on the outer edge of said notch adjacent said strap upper edge and opposite said first shoulder, said shoulders located so as to snappably receive a waler within said notch.

3. The tie of claim 1, wherein said first end portion has a beveled edge, adapted to penetrate a polystyrene panel to allow insertion of said first end portion of said tie through a panel.

* * * * *